US006000183A

United States Patent [19]

Newman

[11] Patent Number: 6,000,183

[45] **Date of Patent: *Dec. 14, 1999**

[54] RETAINING WALL FACE PLATES

[76] Inventor: Anthony E. Newman, 2340 Horizon Cir., Shakopee, Minn. 55379

[ * ] Notice: This patent issued on a continued prosecution application filed under 37 CFR 1.53(d), and is subject to the twenty year patent term provisions of 35 U.S.C. 154(a)(2).

[21] Appl. No.: 08/796,976

[22] Filed: Feb. 7, 1997

[51] Int. Cl.[6] ..... E04F 13/00

[52] U.S. Cl. ..... 52/311.1; 52/596

[58] Field of Search ..... 52/311.1, 596, 52/604, 612, 390, DIG. 13; 40/594, 600, 908; 405/284–286

[56] References Cited

U.S. PATENT DOCUMENTS

| | | | |
|---|---|---|---|
| 776,441 | 11/1904 | Veyon | 52/604 |
| 1,659,962 | 2/1928 | Schaeffer | 52/604 |
| 2,751,775 | 6/1956 | Sergovic | 52/604 |
| 2,951,001 | 8/1960 | Rubenstein | 52/311 X |
| 3,194,724 | 7/1965 | Sergovic | 52/604 |
| 3,290,849 | 12/1966 | Wright . | |
| 3,687,771 | 8/1972 | Meijer . | |
| 3,740,910 | 6/1973 | Taylor . | |
| 3,962,504 | 6/1976 | Sherwin . | |
| 4,644,719 | 2/1987 | Salazar . | |
| 4,831,802 | 5/1989 | Cromwich | 52/311.1 X |
| 4,914,876 | 4/1990 | Forsberg . | |
| 4,997,316 | 3/1991 | Rose . | |
| 5,014,488 | 5/1991 | Evangelos . | |
| 5,017,049 | 5/1991 | Sievert | 52/604 X |
| 5,159,801 | 11/1992 | Schmidt | 52/604 X |
| 5,350,256 | 9/1994 | Hammer . | |
| 5,384,999 | 1/1995 | Roche | 40/600 X |
| 5,428,914 | 7/1995 | Whitehouse | 40/594 X |
| 5,465,544 | 11/1995 | Ghahary . | |
| 5,474,405 | 12/1995 | Anderson . | |
| 5,555,660 | 9/1996 | Whitehouse | 40/594 X |
| 5,788,423 | 8/1998 | Perkins | 52/604 |

OTHER PUBLICATIONS

3M, "Dual Lock Reclosable Fasteners; General Description," Mar. 1986, 3M, St. Paul, Minnesota.

3M, "Dual Lock Industrial Fasteners; SJ 3748," Jul. 1995, 3M, St. Paul, Minnesota.

3M, "Dual Lock Industrial Fasteners; SJ 3737," Jul. 1995, 3M, St. Paul, Minnesota.

3M, "Dual Lock Industrial Fasteners; SJ 3755," Jul. 1995, 3M, St. Paul, Minnesota.

3M, "Dual Lock Industrial Fasteners; SJ 3767," Jul. 1995, 3M, St. Paul, Minnesota.

"Gravity Wall Installation," Web Page: http://www.allanblock.com/gravinst/gravinst.htm (on Dec. 31, 1996), Allan Block Corp., Edina, Minnesota.

*Primary Examiner*—Beth Aubrey
*Attorney, Agent, or Firm*—Michael S. Sherrill

[57] ABSTRACT

A decorative face plate and modular retaining wall block combination is presented that allows the decorative face plate to be removably attached to a front face of the wall block. Each face plate is manufactured so that one or more face plates will cover the front face of the modular block. The block itself has a front face with at least one flat surface on which the face plates can be attached. Various mechanical attachment mechanisms for attaching the face plates to the modular retaining block are presented. In one embodiment, a matching pair of positive locking, reclosable fasteners are used, with one member of the pair attached to the block and the other member to the face plate. The reclosable fasteners preferably have interlocking stems with mushroom shaped heads. The reclosable fastener attached to the block can be situated in a recess found on the flat surface. Alternatively, the face plate can be attached to the modular wall block through a magnetic snap, interlocking clips or hook and loop tape. In addition, the face plate can be adhesively attached to the block or can be attached through magnets. A method of constructing a modular retaining wall with a decorative face plate is also presented.

8 Claims, 3 Drawing Sheets

FIG. 3
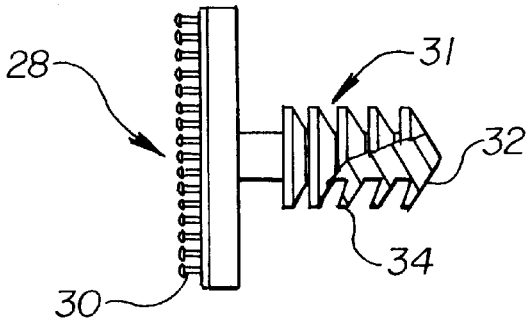
FIG. 4
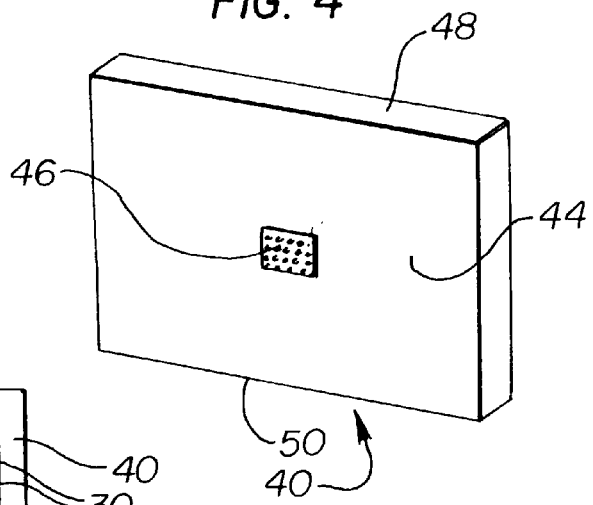
FIG. 5a
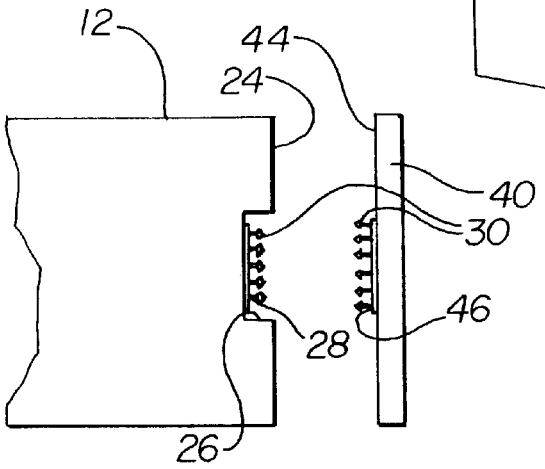
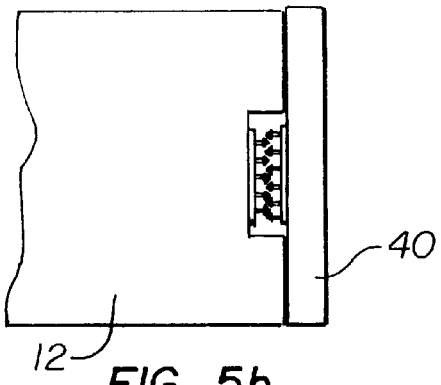
FIG. 5b
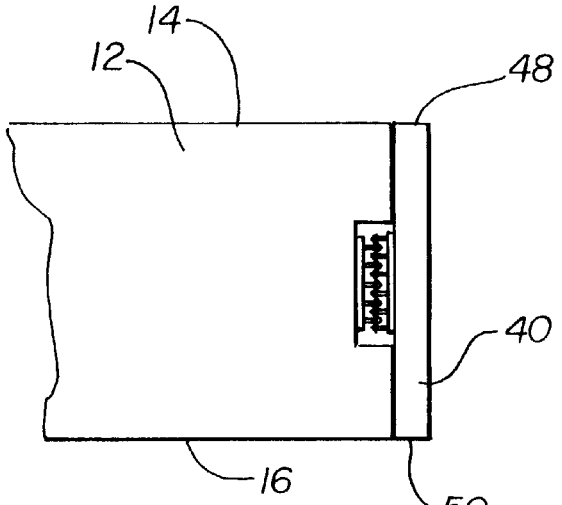
FIG. 5c

RETAINING WALL FACE PLATES

BACKGROUND OF THE INVENTION

This invention relates to the field of modular retaining walls, particularly to the development of replaceable plates designed to provide a decorative facing on a modular retaining wall.

The recent development and advancement in the field of modular retaining walls has been a boon to the do-it-yourself homeowner and the small contractor. Modular retaining walls, also known as mortarless wall or dry stack wall systems, allow the creation of retaining walls without using mortar between the bricks or blocks. In place of mortar, modular retaining walls blocks rest directly upon a lower layer of blocks. The lowest layer is typically buried or partially buried in earth. As in all retaining walls, the back side of the wall is back-filled with the dirt being retained. The retained earth tends to push the wall forward. In modular retaining walls, the blocks are prevented from sliding relative to one another due to a lip incorporated into each block, or through the use of pins that at least partially traverse two adjoining blocks. In most cases, the modular retaining wall is constructed so that each successive layer of modular blocks is placed on the lower level slightly to the rear of center, so that the entire wall leans backwards into the earth being retained.

If the retaining wall is short enough (generally about four feet tall), the wall is typically constructed as a gravity wall. Gravity walls rely on the weight of the modular retaining wall blocks and the slight backward lean of the wall described above to prevent the wall from tipping due to the force of the back-filled dirt. Modular retaining walls may also be used to construct taller walls. In these cases, the wall is generally reinforced by additional means such as the geogrid tie-back sheet described in U.S. Pat. No. 4,914,876 to Forsberg. However, even reinforced modular retaining walls still have the general characteristic of modular blocks resting directly on a lower row of blocks without the use of mortar.

Typically, modular retaining wall blocks are formed by molding a colored concrete mixture into the desired shape. The front face of each block, which forms part of the wall face when the retaining wall is completed, is generally given a rough hewn look so as to simulate split rock. Alternatively, the block could be molded with a flat front face that gives a simulated brick wall appearance to the finished wall.

Unfortunately, this method of creating a decorative face to a modular retaining wall limits the variety of looks that such a wall can have. The rough hewn face is widely used, leaving many users hoping for a more distinctive look to their wall. In addition, the flat front face of a colored concrete block cannot successfully duplicate the rich colors and ordered pattern created by a brick and mortar wall.

The color and texture of modular blocks can be overcome by producing the blocks through a process other than molded concrete. For instance, modular wall blocks could be made entirely out of more attractive (and expensive) materials such as marble or clay. However, since modular retaining walls depend upon their size and weight to hold back the retained wall, making the blocks out of a more attractive material quickly becomes prohibitively expensive.

It is possible to manufacture a more decorative facing directly onto the block. In U.S. Pat. No. 3,687,771 to L. Meijer, a method was disclosed for constructing a concrete block with a plastic or paper base laminate for the front face. Applying this technique to modular retaining blocks would allow the majority of the block to be formed of less expensive materials. The facing could be molded into the main body of the block, as explained in the U.S. Pat. No. 3,687,771 patent, or could form part of an offset facing section, as described in U.S. Pat. No. 3,290,849 to Wright.

Regrettably, the use of a modular retaining wall block that has a more expensive decorative facing molded to its front creates several problems. First, the creation of a multi-component block involves the expensive process of securing the facing to the remainder of the concrete block. For instance, the method described by L. Meijer utilizes a complicated process of applying different resin layers to the block, as shown in FIGS. 2 and 5.

In addition, the facing itself is susceptible to damage during storage and shipping of the block, and during the construction of the modular retaining wall itself. The cost of constructing such a wall would be increased either by the cost of preventing damage to the block face (through the use of a removable pad), or by the cost of blocks damaged during shipment and construction.

Finally, a molded-on face has the disadvantage of being permanently attached to the modular block. If alternative facings are to be offered for sale at a retail outlet, the outlet must stock a large inventory of modular blocks that differ only in the facing applied. The permanency of a molded-on face also prevents the re-facing of an existing wall at a later date.

What is needed is a method for removably attaching a face plate to a modular retaining wall after the wall has been constructed. Unfortunately, known methods for facing an existing wall cannot be adapted for modular retaining walls, as seen below.

One technique for facing a wall is through the creation of a simulated brick, stone, or tile wall panel, as exemplified in U.S. Pat. No. 4,644,719 to Salazar, and U.S. Pat. No. 3,740,910 to Taylor et al. In these techniques, a large panel of the desired look, such as a simulated brick wall, is constructed so as to be easily attached to a wood, or concrete block wall. However, such panels could be applied only to walls with large, flat areas on which the panels could be affixed. One of the primary advantages of modular retaining walls is their ability to create gracious, curving walls; walls that would be unsuitable for receiving a wall panel.

A second alternative is to affix standard wall or floor tiles to the modular wall. The use of wall tiles is well known, an example of which can be found in U.S. Pat. No. 3,962,504 to Sherwin. Unfortunately, most modular retaining wall blocks have rough hewn faces, and therefore do not contain a surface upon which the tile can be affixed. Alternatively, flat face blocks generally have enough decorative texture in the mold as to prohibit the creation of the good adhesive bond with the tile. Even if an effective bond to the tiles could be formed, tiles cannot be attached effectively since the misalignment of adjacent stones prevent tiles from being attached across multiple stones. Finally, standard methods of affixing tiles do not allow for the later removal and replacement of tiles, a benefit that would be useful in cases of tile damage or a desire for a different wall appearance.

A third alternative for facing a preexisting wall is to form a decorative facing cap that fits over each block, as described in U.S. Pat. No. 5,465,544 to Ghahary. In this technique, a facing cap for blocks such as bricks or cinderblocks is formed with a lightweight sheet having dimensions marginally larger than the block and a lip that extends upward from the sheet edges. The facing cap slips over the entire face of the block, and is held in place by the lips which grab the sides of the block, as shown in FIG. 3 of U.S. Pat. No. 5,465,544. Additionally, the cap can be held in place with adhesives. Although novel, this technique cannot be applied to modular retaining walls. Since modular walls are formed without mortar, individual blocks rest directly on top of and adjacent to one another. Because of this direct contact, the lips found on the facing cap of U.S. Pat. No. 5,465,544 would be unable to grasp the edges of the modular wall block.

The present invention overcomes these limitations in the prior art by providing a face plate that can be removably attached to a modular wall after the modular wall blocks are positioned into place.

SUMMARY OF THE INVENTION

The face plate of the present invention is able to overcome the disadvantages of the prior art by being designed to be removably attached to a modular wall block. Each face plate is manufactured so that one or more face plates will fit exactly onto the front face of the modular block. The block itself has a front face with at least one flat surface on which the face plates can be attached.

The mechanism for attaching the face plates to the modular retaining block can vary. In one embodiment, a matching pair of positive locking, reclosable fasteners are used, with one member of the pair attached to the block and the other member to the face plate. The reclosable fasteners preferably have interlocking stems with mushroom shaped heads. The reclosable fastener attached to the block can be situated in a recess found on the flat surface. Alternatively, the face plate can be attached to the modular wall block through a different type of mechanical fastener such as snaps, interlocking clips or hook and loop tape, or the face plate can be adhesively attached to the block.

BRIEF DESCRIPTION OF THE DRAWINGS

FIG. 3 is a sectional view of a pop-in stud fastener.

FIG. 4 is a perspective view of a face plate showing the back thereof.

FIGS. 5*a*–5*c* are partial sectional views of a block and a face plate, with FIG. 5*a* showing the block and face plate aligned for attachment, FIG. 5*b* showing the reclosable fasteners engaged, and FIG. 5*c* showing the reclosable fasteners interlocked.

DETAILED DESCRIPTION OF THE INVENTION

Figure 1:
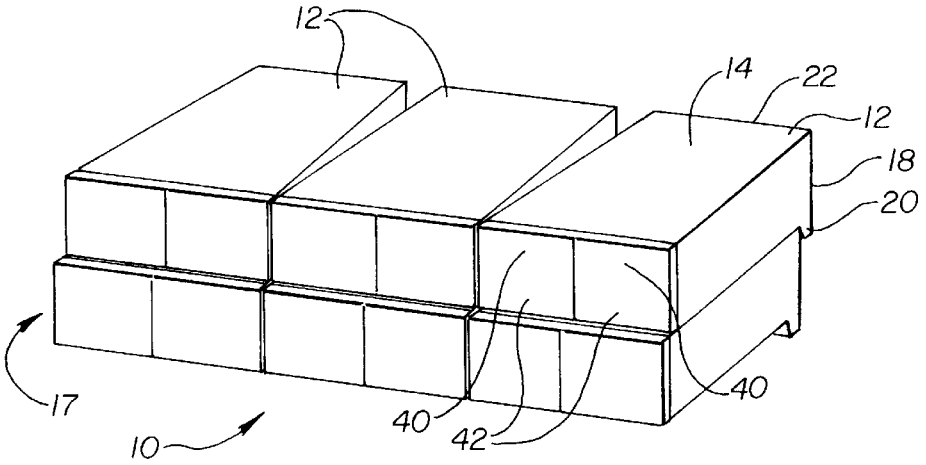
FIG. 1 is a perspective view of a modular retaining wall constructed with the blocks and face plates of the present invention.

FIG. 1 shows a modular retaining wall 10 constructed using the present invention. The wall 10 is made of a plurality of modular retaining wall blocks 12, one of which is shown in more detail in FIG. 2. Each block 12 has a top surface 14 and a bottom surface 16 (not shown). The bottom surface 16 rests on the top surface 14 of a lower row 17 of blocks 12. At a rear end 18 of the bottom surface 16 is a protrusion 20, which runs the width of the block 12. This protrusion 20 is designed to abut a top rear edge 22 of a block 12 in the lower row 17. This protrusion 20 serves to help prevent the block 20 from moving relative to the lower row 17.

The use of mechanisms such as protrusion 20 to prevent slippage in modular retaining blocks 12 is well known. Other known prior art methods for preventing slippage of blocks 12 in mortarless retaining walls 10 include protrusions in other locations and the use of pins that at least partially traverse adjacent blocks 12. In addition, it is known to rely entirely on the weight of the block 12 to prevent slippage.

The protrusion 20 also helps to regulate the offset of one row of blocks 12 compared to the lower row 17. It is possible to create a modular retaining wall without an offset, which would result in a completely vertical wall. However, the offset creates a modular retaining wall 10 that leans backward into the earth being retained, and thereby gains greater strength and stability.

A front surface 24 of the block 12 is adapted to receive at least one face plate 40. In FIG. 1, two face plates 40 are shown attached to each block 12. Although the two face plates lie in a common plane in FIG. 1, the front surface 24 could be formed with two or more non-coplanar surfaces for receiving two or more face plates 40.

A channel 26 runs horizontally through the front surface 24. Situated in the channel 26 are two positive locking, reclosable fasteners 28. Preferably, these fasteners 28 are composed of a multitude of stems having mushroom shaped heads 30, as shown in FIG. 3. Such fasteners 28 are available commercially from 3M under the tradename Scotchmate Dual Lock.

The fasteners 28 may be attached to the block 12 in a variety of ways. The preferred technique is to utilize a fastener 28 that has a pop-in stud 31, such as model number SJ 3748 Dual Lock Fastener available commercially from 3M. A pop-in stud fastener 28 has a cap 32 and wings 34 that allow the fastener to be inserted into and held securely with a properly sized hole in the channel 26. The hole (not shown) can be drilled or molded into the block 12. Other mechanisms for attaching the fastener 28 include screws, bolts, pop rivets, adhesives, and insert molding the fastener 28 directly into the block 12.

Face plates 40 are shown in FIGS. 1 and 4. Each face plate 40 has a decorative front face 42. It is the front face 42 that gives the modular retaining wall 10 of the present invention its decorative look. The face plate 40 also has a rear face 44, and top and bottom edges 48, 50 respectively.

The face plate 40 may be made out of a variety of decorative materials. Preferred materials are cut stone, marble, clay (including glazed clay tiles), brick, and plastics of a variety of kinds.

In the middle of the rear face 44 of the face plate 40 is a positive locking, reclosable fastener 46 that is designed to engage one of the fasteners 28 mounted on the block 12. The face plate fastener 46 can be attached to the face plate 40 by the same fastener attachment mechanisms described above. The preferred mechanism is the use of chemical adhesives, since the face plate 40 may be made out of a brittle material.

Preferably, the face plate fastener 46 also has a multitude of stems having mushroom shaped heads 30. However, in order to create an ideal engagement with block fastener 28, the pattern of the stems 30 on the face plate fastener is different than the pattern of stems 30 on the block fastener 28. In the preferred embodiment, model number SJ 3748 Dual Lock Fastener with a pop-in stud is used as block fastener 28, and a Dual Lock Fastener with stem pattern Type 170 or Type 250 is used as the face plate fastener 46. Both preferred fasteners 28, 46 are available through 3M.

Figure 2:
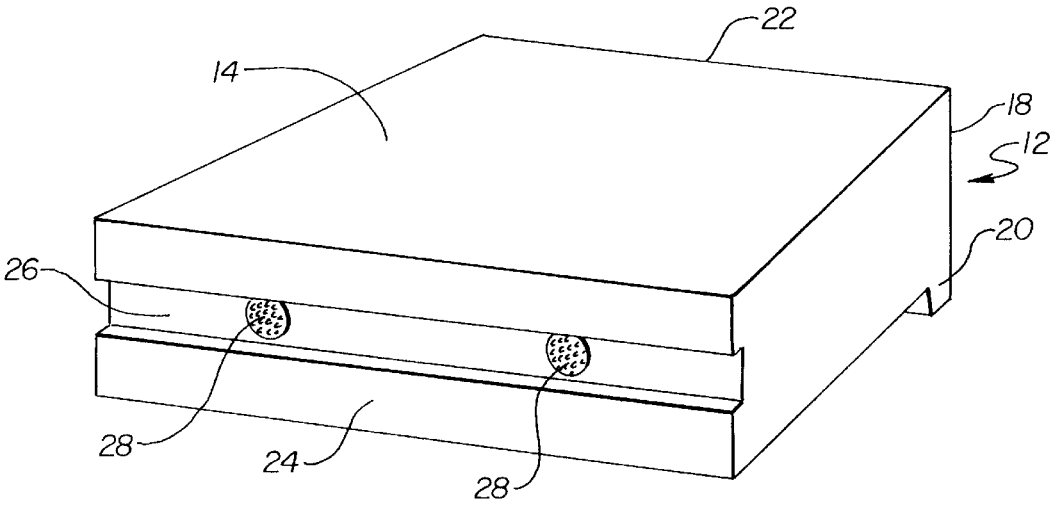
FIG. 2 is a perspective view of a block showing the front, top and side surfaces thereof.

In the preferred embodiment, the block fasteners 28 are positioned such that two face plates 40 can be attached to the front face 24 of the block 12, as shown in FIGS. 1 and 2. The block 12 and the face plates 40 are sized such that the two face plates 40 approximately cover the front face 24 of block 12. Although two equal sized face plates 40 are used per block 12 in the preferred embodiment, the invention also covers the use of one or any number of face plates 40 to cover the front face 24 of the block 12.

FIG. 5*a* shows the face plate 40 positioned to be attached to the front face 24 of the block 12. In FIG. 5*b*, face plate 40 has been moved so as to engage face plate fastener 46 with block fastener 28. The mushroom shaped heads on the stems 30 of the two fasteners 28, 46 begin to bend the stalks of the stems 30. Finally, in FIG. 5*c*, the face plate 40 has been attached to the block 12. The mushroom shaped heads of the stems 30 are now intertwined, creating a secure fastening attachment. Note that the channel 26 has been sized so that the rear surface 44 of the face plate abuts the front surface 24 of the block when the stems 30 are intertwined. Note also that when attached, the top and bottoms edges 48, 50 of the face plate 40 align with the top and bottom surfaces, 14, 16 of the block 12.

Figure 6:
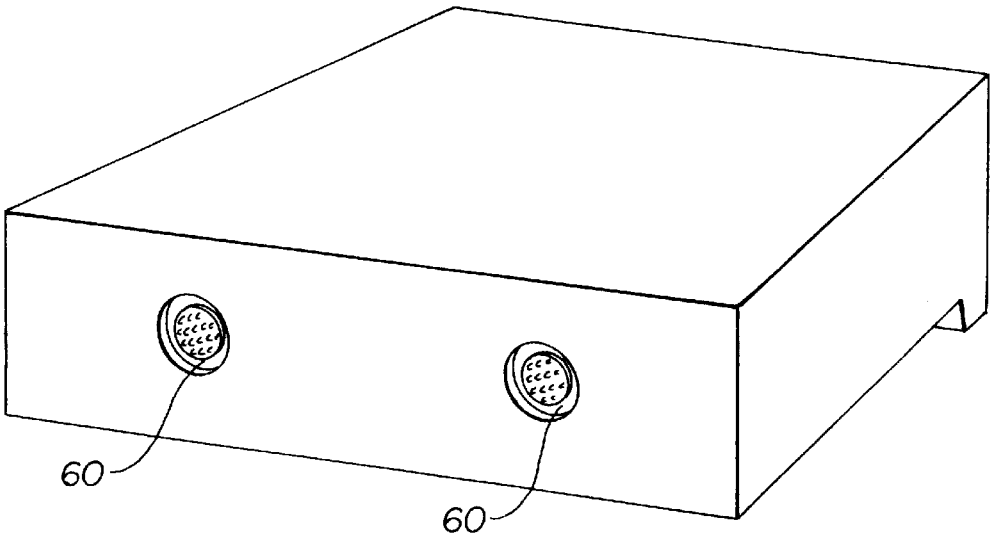
FIG. 6 is a perspective view of an alternative embodiment of a block showing the front, top and side surfaces thereof.

The channel 26 serves to prevent the fasteners 28, 46 from interfering with the abutment of the face plate 40 against the front surface 24 of the block 12. Alternatively, a recessed hole 60 such as that shown in FIG. 6 could be utilized. In addition, the front surface of the block 12 could remain unbroken and a recess could be placed in the rear surface 44 of face plate 40.

Figure 7:
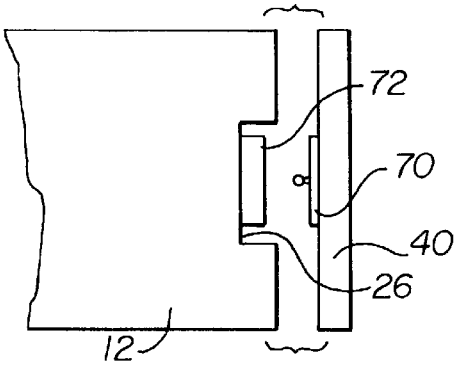
FIG. 7 is a partial sectional view of a block and a face plate showing a second embodiment of the mechanical fastener.

FIG. 7 shows an alternative face plate attachment mechanism. In this embodiment, a magnetic snap pair 70, 72 is used to secure the face plate 40 to the block 12. A male snap connector 70 is affixed to the face plate 40. Likewise, a female snap connector 72 is affixed within channel 26 to the block. The attachment is made through pressing the connectors 70, 72 together. The snap connectors 70 and 72 are further held in place through the use of a magnet, as is well-known in the prior art.

Figure 8:
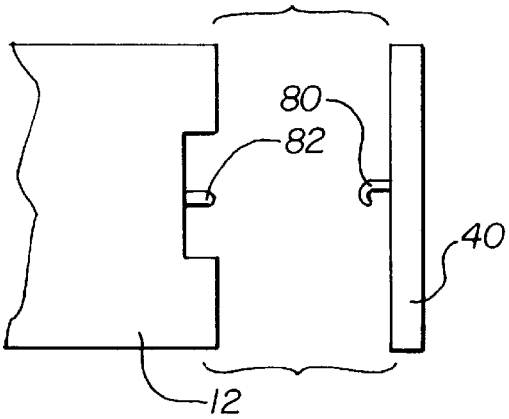
FIG. 8 is a partial sectional view of a block and a face plate showing a third embodiment of the mechanical fastener.

FIG. 8 shows a third embodiment of the face plate attachment mechanism. In this embodiment, a hook 80 is attached to face plate 40, with a mating loop 82 attached in the channel 26. The attachment is made by sliding the hook 80 into the loop 82.

With the snap connectors 70, 72 of FIG. 7 and the hook 80 and loop 82 of FIG. 8, it may be necessary to have multiple attachment mechanisms for each face plate 40. Additional mechanical attachment mechanisms are available and would be obvious in light of the present invention, including the use of hook and loop tape, interlocking clips, and magnets working alone. Each of these mechanisms allow the face plate 40 to be removed from the block 12 after attachment. The use of the channel 26 instead of the recessed holes 60 makes removal easier in cases where the detachment is made by merely pulling on the face plate 40, such as with the positive locking reclosable fasteners described above, or with hook and loop tape.

It would be obvious to design the mechanical attachment such that the attachment would be permanent. Such permanent mechanical fasteners are well-known in the prior art.

Figure 9:
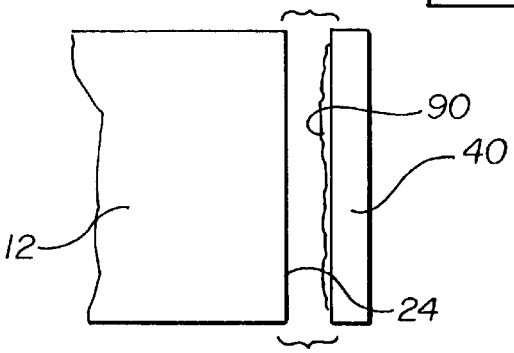
FIG. 9 is a partial sectional view of a block and a face plate showing an adhesive attachment means.

In addition to the use of mechanical attachment mechanisms, a chemical adhesive 90 may be used to secure face plate 40 to block 12, as is shown in FIG. 9. When using chemical adhesive 90, it is no longer necessary to include channel 26 on the front face 24 of block 12. However, channel 26 would be useful even with chemical adhesive 90 when attempting to remove the face plate 40 from an existing wall 10.

The invention is not to be taken as limited to all of the details thereof as modifications and variations thereof may be made without departing from the spirit or scope of the invention.

What is claimed is:

1. A combination useful in the construction of a mortarless retaining wall, comprising:

(a) a block, wherein:

(1) the block has a front, a back, a top surface, a bottom surface, a right side surface, a left side surface and a planar front surface, with the front surface forming edges with the top, bottom, right side, and left side surfaces, and (b) at least one decorative face plate, wherein:

(1) each face plate has a top surface, a bottom surface, a right side surface, a left side surface and a planar rear surface, with the planar rear surface forming edges with the top, bottom, right side, and left side surfaces, and (2) the rear surface of at least one face plate is attached to the front surface of a single block, with one or more face plates attached to the block so as to define a decorative unit on each block having an outer perimeter vertically and horizontally aligned with the edges of the front surface of each block, and (c) an attachment means effective for permitting the decorative face plate to be selected independently from the block, attached to the block before or after incorporation of the block into a retaining wall, and detached from the block after incorporation of the block into a retaining wall without destroying the block.

2. The combination of claim 1, wherein the decorative face plate is attached to the block via a chemical adhesive.

3. A mortarless retaining wall, comprising:

(a) a plurality of blocks, wherein:

(1) the blocks have a front, a back, a top surface, a bottom surface, a right side surface, a left side surface and a planar front surface, with the front surface forming edges with the top, bottom, right side, and left side surfaces, and (2) the blocks are configured and arranged to form a first layer of blocks and a second layer of blocks with the bottom surface of each block in the second layer resting directly upon the top surface of at least one block in the first layer, and (b) a plurality of decorative face plates, wherein:

(1) each face plate has a top surface, a bottom surface, a right side surface, a left side surface and a planar rear surface, with the planar rear surface forming edges with the top, bottom, right side, and left side surfaces, and (2) the rear surface of each face plate is attached to the front surface of a single block, with one or more face plates attached to each block so as to define a decorative unit on each block having an outer perimeter vertically and horizontally aligned with the edges of the front surface of each block, (c) wherein the decorative face plates are attached to the blocks such that the decorative face plates can be selected independently from the blocks, attached to the blocks before or after construction of the retaining wall, and detached from the blocks after construction of the retaining wall without destroying the blocks.

4. The mortarless retaining wall of claim 3, further comprising an anti-slippage mechanism to prevent slippage of the blocks relative to one another.

5. The mortarless retaining wall of claim 4, wherein the anti-slippage mechanism is a protrusion on each block extending downward from the bottom surface of the block proximate the back of the block.

6. The mortarless retaining wall of claim 4, wherein the anti-slippage mechanism is a pin partially traversing into two vertically adjacent blocks.

7. The mortarless retaining wall of claim 3, wherein the face plates are attached to the blocks by a chemical bond.

8. The mortarless retaining wall of claim 3, wherein the face plate are attached to the blocks by a mechanical fastener.

* * * * *